US007935226B2

(12) United States Patent
Song et al.

(10) Patent No.: US 7,935,226 B2
(45) Date of Patent: May 3, 2011

(54) METHOD AND SYSTEM TO REMOVE COKE FROM A COKER DRUM

(75) Inventors: Limin Song, West Windsor, NJ (US); Mark M. Disko, Glen Gardner, NJ (US); Jormarie Alvarez, Fairfax, VA (US); Julio D. Lobo, Baden (CH); Robert J. Chimenti, Short Hills, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 289 days.

(21) Appl. No.: 12/229,136

(22) Filed: Aug. 20, 2008

(65) Prior Publication Data

US 2009/0056759 A1 Mar. 5, 2009

Related U.S. Application Data

(60) Provisional application No. 60/966,651, filed on Aug. 29, 2007.

(51) Int. Cl.
*C10B 47/00* (2006.01)
*B08B 7/00* (2006.01)

(52) U.S. Cl. ..... 201/1; 201/2; 201/3; 134/18; 134/39

(58) Field of Classification Search ..... 201/1, 2, 201/3; 134/1, 18, 39; 702/56; 73/570, 579
See application file for complete search history.

(56) References Cited

U.S. PATENT DOCUMENTS

| | | | | |
|---|---|---|---|---|
| 3,892,633 | A | 7/1975 | Oleszko et al. | |
| 4,410,398 | A * | 10/1983 | Chipman et al. | 201/1 |
| 5,022,268 | A * | 6/1991 | Wolf et al. | 73/602 |
| 5,063,781 | A | 11/1991 | Conforti et al. | |
| 6,772,094 | B2 * | 8/2004 | Tyson | 702/183 |
| 7,340,985 | B2 * | 3/2008 | Claesson et al. | 82/163 |
| 7,374,665 | B2 * | 5/2008 | Eppig et al. | 208/131 |
| 7,594,996 | B2 * | 9/2009 | Colic | 208/391 |
| 2007/0038393 | A1 * | 2/2007 | Borah et al. | 702/56 |

* cited by examiner

*Primary Examiner* — Nina Bhat

(57) ABSTRACT

A method to remove coke from a coker drum is disclosed. The method includes the steps of impinging fluid from a fluid jet on the inside surface of the coker and then determining the vibration signal of the coker drum. The signal is then transformed to determine the amplitude versus frequency by a Fourier Transform of the vibration signal. The amplitude change of the vibration signal as it goes through a maximum, determines when the coke layer has been cut. The fluid jet is lowered into a new layer of coke.

16 Claims, 8 Drawing Sheets

Typical coke cutting operation of a coker drum.

Time-frequency analysis of vibrational signal of coker drum wall during coke cutting. The plot on the top represents time-domain data and the plot on the bottom the time-frequency data. The area in the parenthesis represents the removal of a 10-foot layer of coke Band-filtered vibration signals. The top plot represents original signal, the middle the filtered signal by a digital band filter of 1500-2300 Hz, the bottom the filtered signal by a digital filter 3000-4500 Hz.

Vibration energy analysis of vibration signal of the first mode.
The top plot represents original vibration signal. The bottom the vibration energy of 1st vibration mode centered at 1800 Hz

METHOD AND SYSTEM TO REMOVE COKE FROM A COKER DRUM

This application claims the benefit of U.S. Provisional Application 60/966,651 filed Aug. 29, 2007.

BACKGROUND OF THE INVENTION

The present invention relates to removing coke from a coker drum in a delayed coker unit. In particular, the present invention relates to coke cutting using high pressure water jets. Delayed cokers are operated in a semi-batch mode, with at least two drums. While one is being filled and coked, the other is de-coked. During the coking cycle, the drum is gradually filled with liquid feed at about 900 degree F. from a nozzle at the bottom of the drum, vapor product leaves the drum at the top, and coke forms inside the drum as the result of a complex solidification process. During de-coking cycle, the drum is first cooled by steam or water. After cooling and draining, a high pressure rotary jet is used to cut the coke loose, which is removed from the bottom of the drum. Since the high pressure water jet literally cuts through the layers of coke in the coker drum, the process of emptying the coke drum using the water jet is commonly called "coke cutting."

Delayed cokers are recognized as one of the primary capacity bottlenecks at a refinery. Quenching, cutting and removal of the solid coke are the limiting steps of the coker operation. Currently there are very few measurements on a coker for operators to determine actual condition of de-coking operation and make real-time adjustment. The coke cutting and removal in most delayed cokers is a labor-intensive manual operation.

The cutting process relies heavily on the person operating the hydraulic decoking system. The coke cutting operator uses the rotary water jet to cut through the coke, starting from the top of the drum, removing one layer of coke each time, then moves the jet downward to cut the next layer. The operator determines when to move to next layer either by fixed-time routine or by listening to the air-born sound emitted from the top opening of the drum. Very often, more round trips of the water jet are performed over the layer just to increase the probability of complete removal of all the coke in that layer. When the operator could not determine the cutting condition from his own sensing capability (e.g., when moved from the vicinity of the drum opening to an isolated control room), it is not only very challenging to cut coke efficiently but also increases the probability of equipment failure such as bending damage of the jet bit due to coke fallouts from residual coke left behind (i.e. above the water jet cutting tool).

The operator is responsible for controlling or driving the rotary water jet down and up the coker drum until he thinks that all the coke inside the drum has been removed. The operator becomes the sole decision maker during the cutting operation and so the potential for error is very high. In addition, the cutting time and quality also vary from operator to operator and from cycle to cycle. To make the coke cutting operation more efficient, more consistent, and safer, there is need to monitor the coke cutting operation with sensors and a computerized intelligent system to assist operators in coke cutting.

The present invention uses acoustic approach to measure the drum wall vibration caused by the coke cutting, and convert the vibrational signature measurement into an intelligent decision-making system which is capable of classifying the different conditions of the cutting operation in real-time. This intelligent capability leads to partial or full automation of the coke cutting operation. The invention allows for very efficient coke cutting, largely eliminating the possibility of errors that arise from misjudgments of the coke cutting operator. The invention converts coke cutting from an arbitrary process lacking of controls into a very reliable and consistent operation. This translates into safer operation, lower operational costs and higher productivity.

SUMMARY OF THE PRESENT INVENTION

A coker drum or vessel experiences a variety of vibrations as a result of high pressure water jets used to empty the coker drum when it is filled with solid coke material. The invention is a method that allows for automated control of the high pressure water jets by correlation of coke cutting with the vibrational signature measured at the coker drum wall. Acoustic transducers, or other non-contact method such as an optical method, mounted on exterior surface of the coke drum, are used to measure the vibrations of the coker drum wall as a result of the high pressure water jets. The wall vibration signature when the high pressure water jets strikes the inside of the coker drum wall is significantly different from that produced when the jets cut through the coke material. For example, the vibration levels at certain resonance frequencies of the drum wall, when the jets hit the interior wall, is much higher than that when the jets hit the coke. In this way we can distinguish between an area of the coker drum that is empty of coke and an area of the coker drum that contains a layer of coke. The invention is a method that decides when a section of the coker drum is completely free of coke based on the measurement and analysis of the vibration signatures and thus it can be used to drive the high pressure water jets into a different position in the coker drum where coke is still present. The process would continue until the coker drum has been completely emptied of coke.

The invention eliminates the dependency of the efficiency of coke cutting on the skill level of the water jet operator since the method allows for automated control of the coke cutting operation. As a result, coke cutting efficiency and consistency are highly improved.

DETAILED DESCRIPTION OF THE PREFERRED EMBODIMENTS

Figure 1:
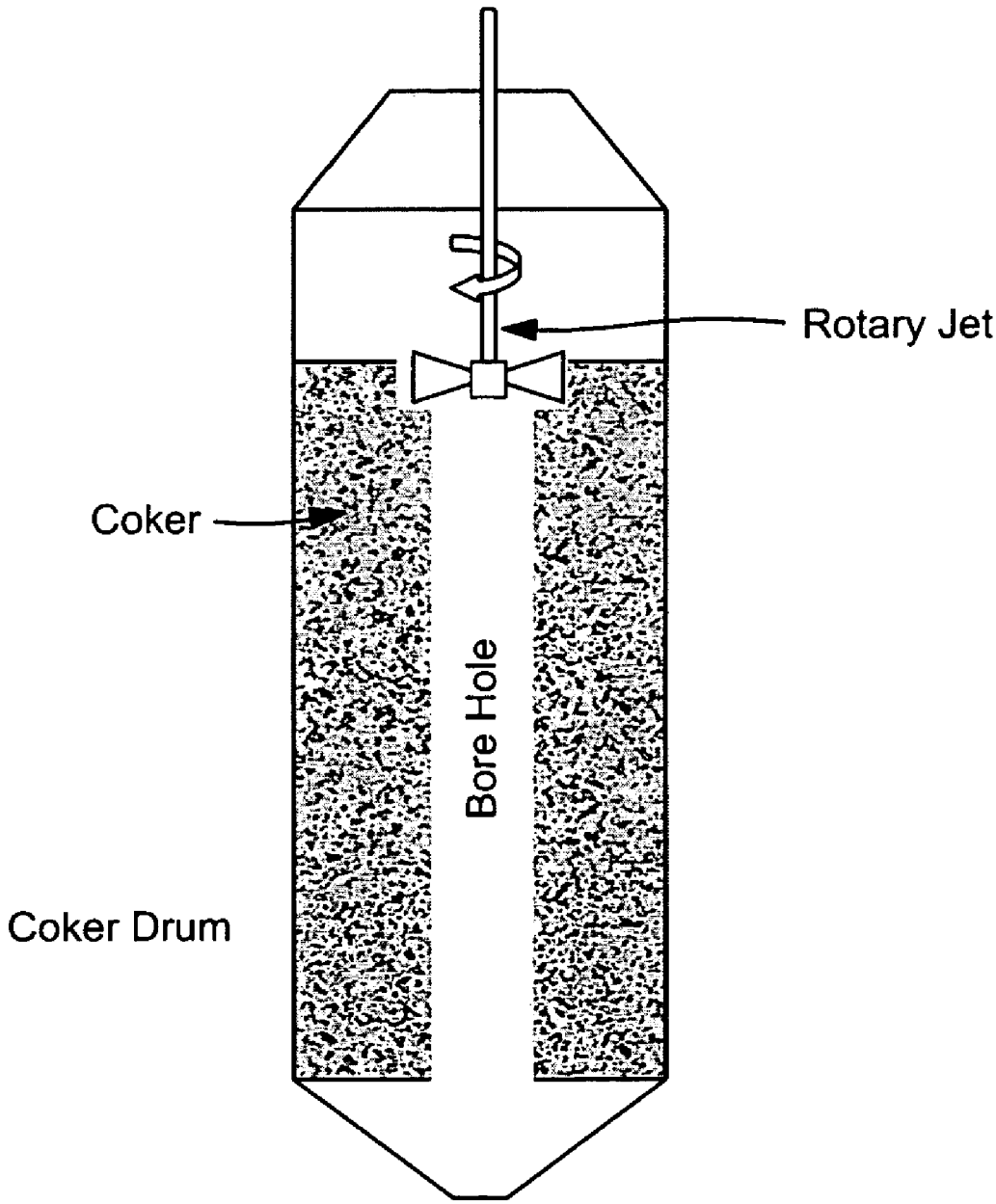
FIG. 1 shows a typical coke cutting of a delayed coker.

FIG. 1 illustrates typical coke cutting process of a delayed coker. First, the operator uses the high pressure water jets to cut a pilot hole along the center of the drum, through which loose coke can easily fall out of the drum. Then the operator uses the rotary jets to cut through the coke; starting from the top of the drum, remove one layer of the coke each time, and lower the jets to cut the next layer. When cutting into the coke, the high pressure water jets impact on and fracture the coke mass. The impacts and fractures produce stress waves that propagate through the coke layer toward the drum wall. Since the coke layer is highly dissipative due to grain or void scattering and absorption, the stress waves become weak when they reach the wall. As a result of coke attenuation, the vibration of the drum wall induced by the stress waves, is relatively small. The thinner the coke layer gets, and the less attenuation of the stress waves through the layer is, the stronger the wall vibration becomes. When the jets directly impact on the wall after complete removal of the coke layer, the wall vibration level reaches the highest. Because the jet impact behaves more or less like a high pressure impulse, multiple vibration modes of the drum wall are excited. The wall vibration at the resonance frequencies associated with those modes become dominant in the signal. This qualitative description of the drum wall vibration characteristics becomes clear when the example of actual vibration signals are acquired during the coke cutting operation of a refinery delayed coker and analyzed, as shown in the next section.

Figure 2:
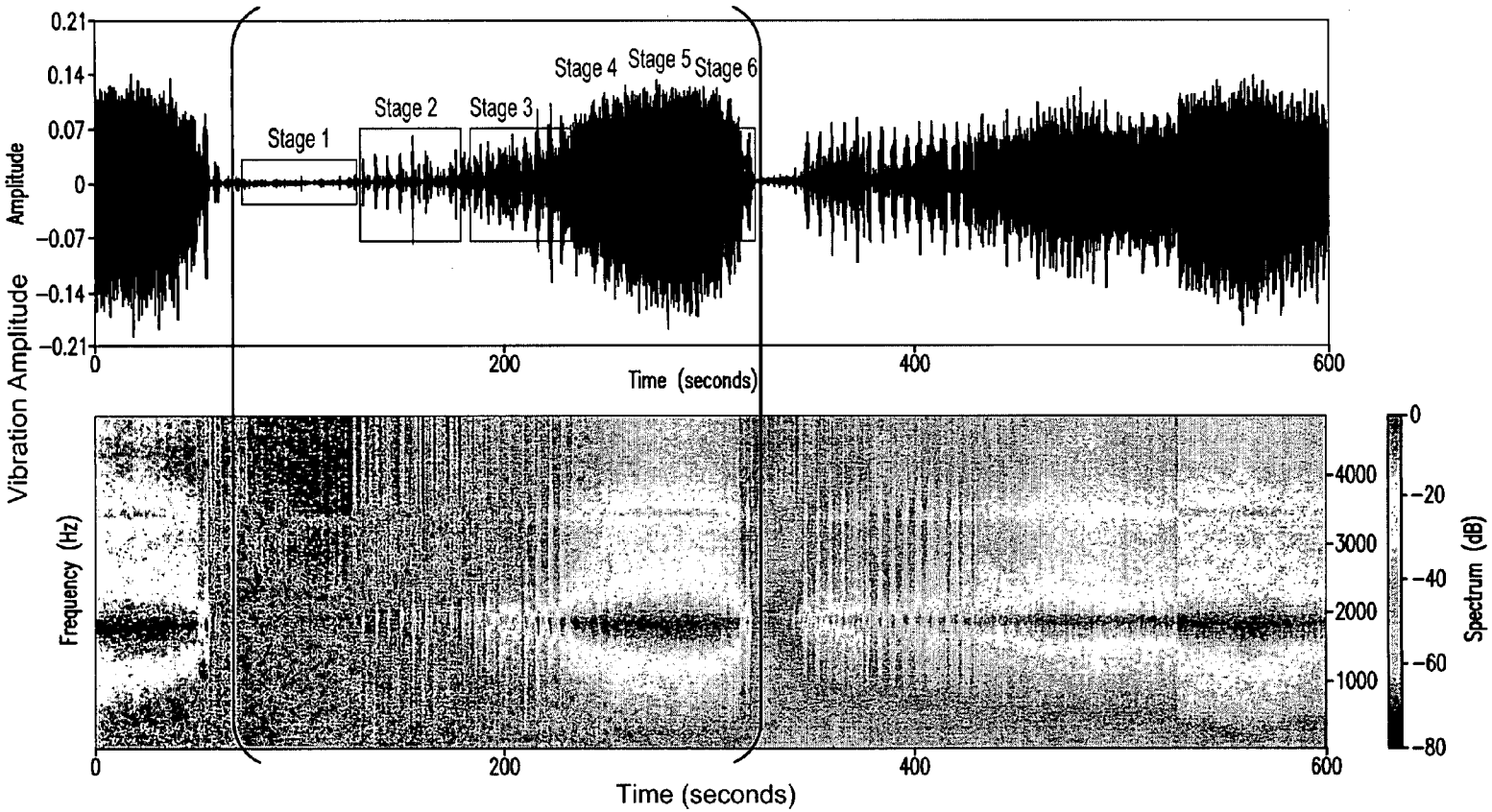
FIG. 2 shows the time-frequency analysis of the vibrational signal of the coker drum wall during coke cutting. The plot on the top represents the time domain data and the plot in the bottom represents the frequency domain data. The area in parenthesis represents the removal of a 10 foot deep layer of coke.

Vibration signals of coker drum wall during coke-cutting operation of a refinery coker were acquired and are shown in FIG. 2. The vibrational signals of the coker drum, when the water jet drill impinges directly on the coker drum wall, is very different from the vibrational signal of the coker drum when the water jet drill impinges into a layer of coke. A time-frequency analysis of the vibrational signal of the coker drum wall, as shown in FIG. 2, revealed two very distinct vibration modes when the water jet is striking the coker drum wall directly. For this particular coker drum, the first mode is observed at about 1800 Hz and the second mode is observed at around 3600 Hz. These vibrational modes are not observed or much weaker when the water jet drill strikes a layer of coke, as shown in FIG. 2. The frequencies and levels at those vibration modes are similar from layer to layer as long as the layer of coke is completely removed and the water jets impacting on the wall directly. The invention correlates the analysis of the vibrational signal of a coker drum during the coke cutting process with the decoking condition at any given time.

Figure 3:
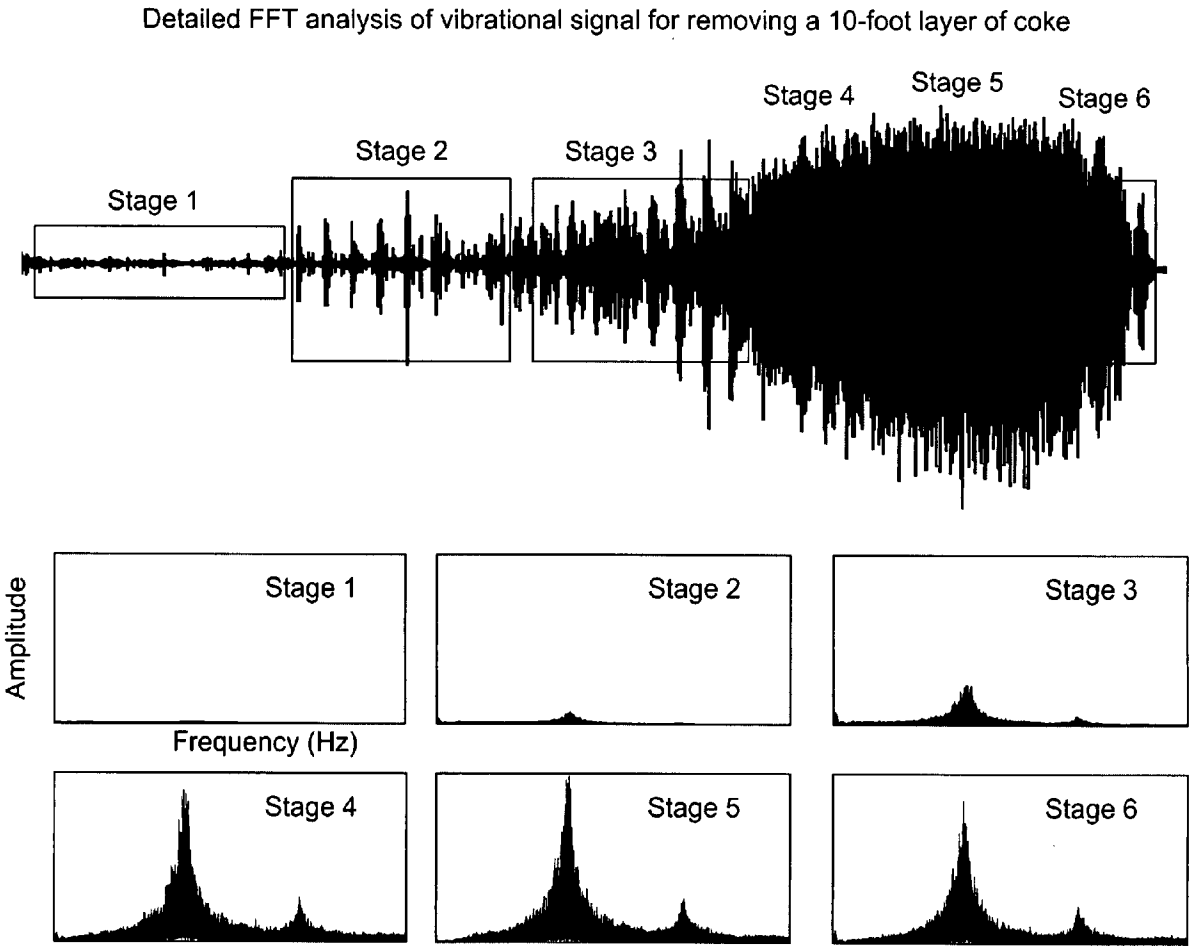
FIG. 3 shows a detailed FT (Fourier Transform) analysis for the removal of a 10 feet deep layer of coke during the cutting process.

A detailed FFT analysis of the time progression for the removal of a 10-foot layer of the coke is shown in FIG. 3; six different stages are identified:

(1) The water jet hitting the layer of the coke without reaching the drum wall—no or negligible modal vibrational signal observed;

(2) The water jet starts penetrating deeper into the coke layer and just begins to reach the coker drum wall at discrete locations—modal vibration signal begins to emerge;

(3) The frequency of the water jet impact on the coker drum wall increases and thus the modal vibration signal at the coker drum resonance frequency increases as well;

(4) The layer of coke is almost completely removed and thus the high intensity of the modal vibration signal;

(5) Modal vibration reaches its maximum since the entire coke layer has been removed and the water jet is striking the coker drum wall directly;

(6) The water jets start moving downward into a new layer of coke and the intensity of the modal vibration signal decreases.

Figure 4:
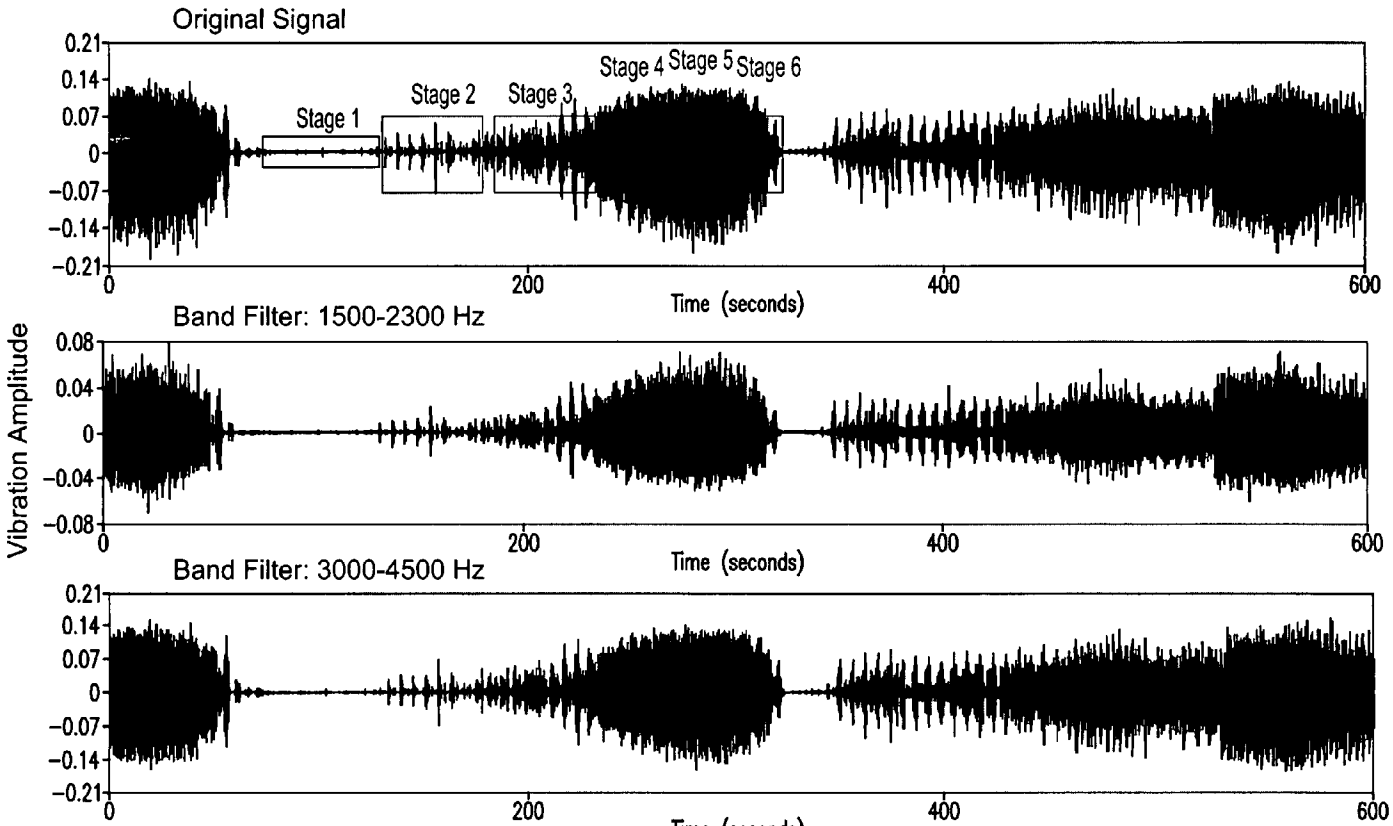
FIG. 4 shows a band-filtered time domain vibrational signal. First plot represents the original signal without filters, the second and third plots show filtered signals in the frequency ranges indicated.

To extract the modal vibration at 1800 Hz and 3600 Hz and improve signal to noise ratio, two digital band filters, with frequency bands of 1500-2300 Hz and 3000-4500 Hz respectively, were applied to the original vibration data. The filtered signals are shown in FIG. 4. The results show that the two modal vibration signals preserve the cutting signature with high fidelity showing a similar temporal pattern to the original signal. Therefore, either of these frequency bands may be used or both of them may be combined for coke cutting monitoring. The higher frequency mode may be preferred because of low background noise contamination.

Figure 5:
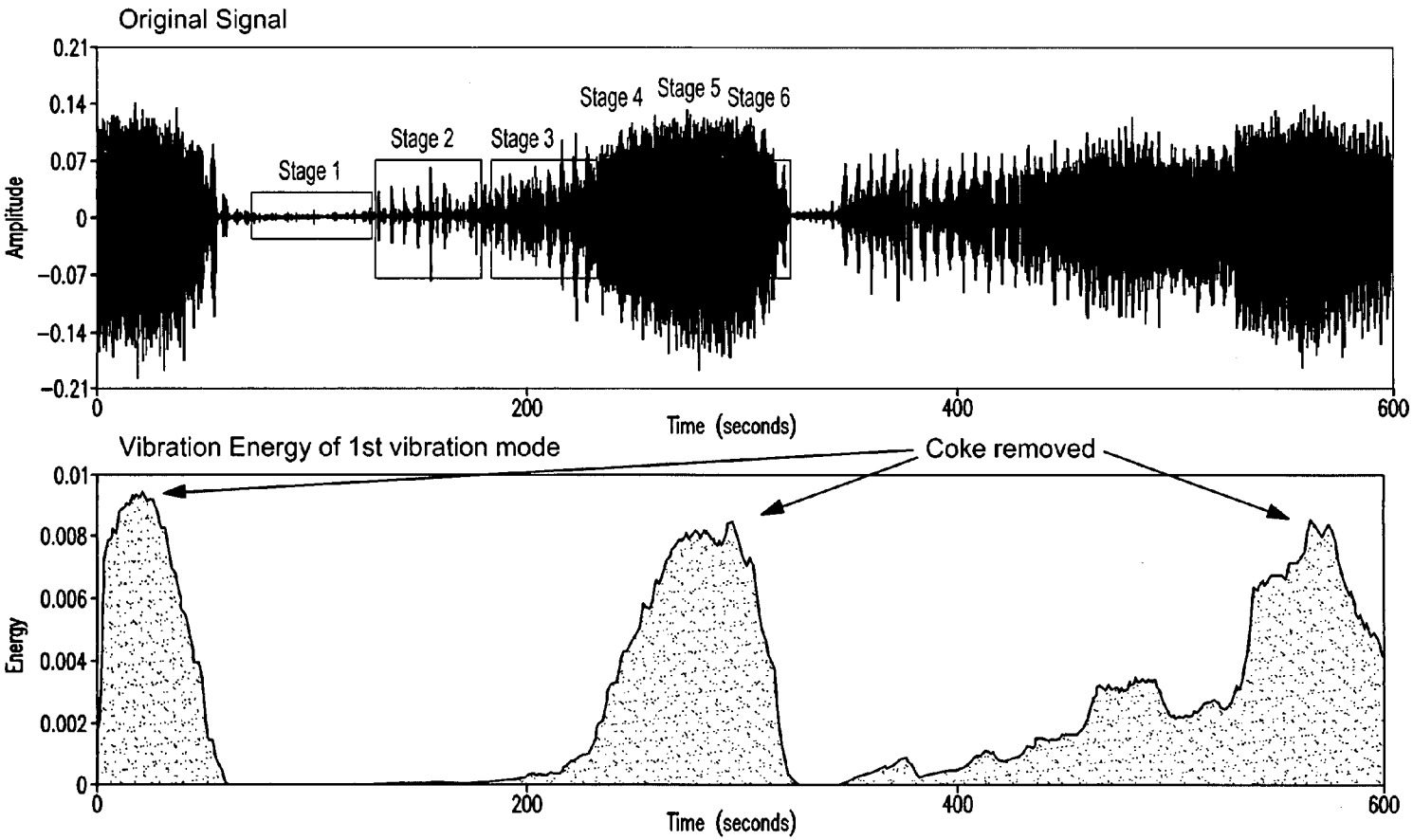
FIG. 5 shows the vibration energy of the vibration mode of 1800 Hz.

To derive a single parameter for monitoring the coke cutting condition, a moving window of fixed length is applied to the band-filtered modal vibration signals and the total vibration energy (sum of the squared signal amplitudes) within the window is computed as a function of time. FIG. 5 shows the vibration energy of the first vibration mode of 1800 Hz. It is clear that the vibration energy reaches a maximum level when the coke layer is completely removed and the water jets are directly impacting on the coke drum wall. The maximum vibration energy level appears to be quite similar for cutting of different layers, which provides a robust measure for decision making when the layer is completely removed.

Figure 6:
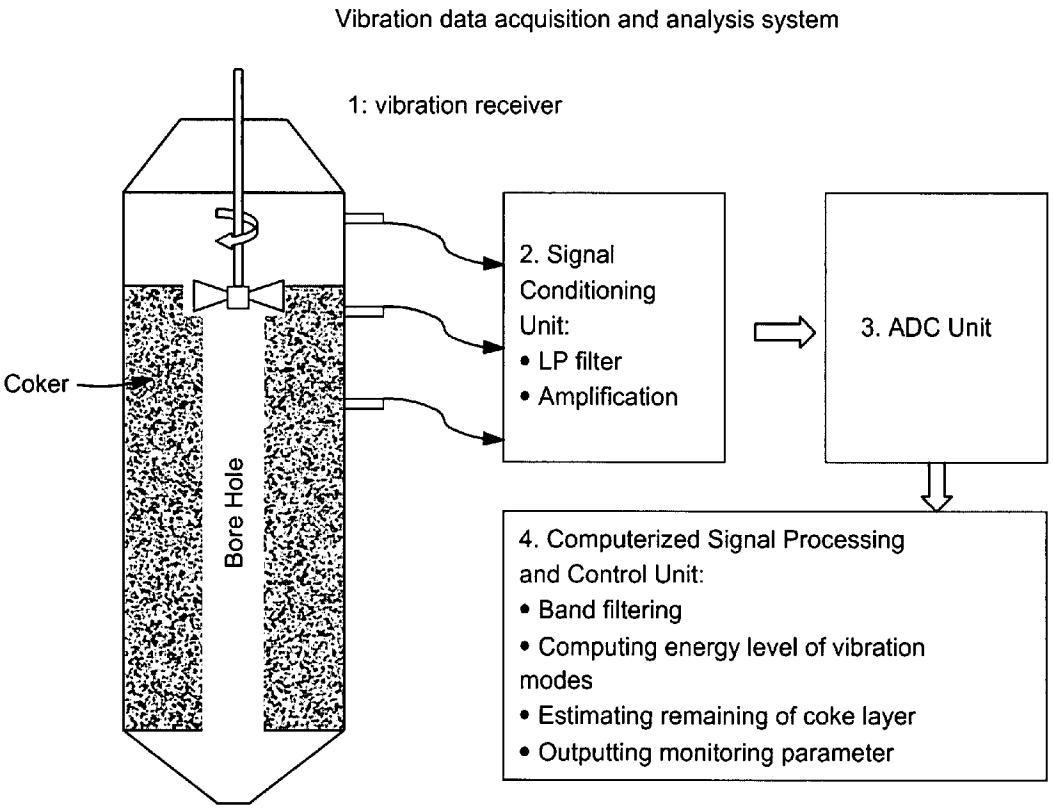
FIG. 6 shows a schematic diagram of the system of the present invention.

The system of the present invention is a vibration data collection and signal analysis system as shown in FIG. 6. It consists of one or more vibration receivers (1), a signal conditioning unit (2), an analog-to-digital converter unit (3), and a computerized signal processing unit (4). If a single receiver is used, the preferred placement of the receiver is on exterior wall of the coker drum above the maximum level of the coke. For multiple receivers, one of them is placed on the exterior wall of the coker drum above the maximum level of coke, and others are placed on the exterior wall of the drum with preferably equal distance between two adjacent receivers. The vibration receivers (1) measure the amplitude of the wall vibration of the coker drum, x(t), where t is the time. The analog vibration signal from the receivers (1) is conditioned (for example, low-pass filtering and amplification) by the signal conditioning unit (2), and converted to digital signals, x(n), by analog-to-digital converter unit or ADC (3). Then the digital signal is sent to a computer system (4) for further on-line signal analysis. The output of the signal analysis in (4) is the value of a coke-cutting monitoring parameter, C, and C takes on the value of either one or zero, where C=1 indicates that the coke layer is completely removed.

The first step in the signal analysis is application of band filters to extract the modal vibration signal, the portion of the measured signal that is associated with the certain mode of wall resonance. For example, the vibration signal amplitude of mode m with a mode frequency $f_m$ is extracted approximately with an FIR (finite impulse response) filter as follows:

$$y_m(n) = \sum_{k=0}^{N} a_{km} x(n-k) \tag{1}$$

where n is the time step, x(n) is original signal, y(n) is the filtered signal of the mode m, $a_{km}$ is the coefficients of the band filter, N is the order of the filter. Other type of filters such as infinity impulse response filters can also be used. The extraction of the mode can also be done in the frequency domain. For a specific coker drum operated at a given condition, the vibration modes and mode frequencies are relatively constant, though small variation with time is expected due to normal fluctuation of operating condition such as wall temperature. Design of a proper band filter for a given mode is done off-line by acquiring wall vibration during coke cutting and examining the frequency spectrums to identify the vibration modes, and mode frequencies. To account for variation of the mode frequencies due to fluctuation in operation condition, a frequency band is selected for each mode with a center frequency equal to the nominal mode frequency value from off-line frequency analysis. Then the filter coefficients are determined by the lower and upper cutoff frequencies identified for the mode. For multiple modes, multiple band filters with different frequency bands are applied. The next step is to compute the vibration energy, $z_m$, in the mode m with a moving window method as follows:

$$z_m(n) = \sum_{k=p}^{n} y_m^2(k) \tag{2}$$

where n is current time step, and n-p is the length of the moving window. The window length should be greater than the period of the vibration of the given mode (inverse of mode frequency) and typically sufficient long to include several periods of the mode vibration. The vibration energy can also be estimated in frequency domain. Then the third step is to compute the conditional probability of occurring of the event that current layer of coke is completely removed, given the vibration measurements. One approach to estimate the conditional probability is to use the following approximation:

$$P(E/Z_m) = \frac{N_E}{N_T} \tag{3}$$

where E denotes the event of empty coke, $Z_m$ is the data set of $z_m(n), z_m(n-1), \ldots z_m(n-q)$, $N_T$ is total number of data points in $Z_m$ which is equal to n−q, and $N_E$ is total number of data points in $Z_m$ that is equal to or greater than a threshold of modal vibration energy, $z_{threshold}$. When P is equal to or greater than a probability threshold, $P_{threshold}$, then the current layer is estimated to be completely removed, and monitoring parameter of coke cutting, C, is, set to one. Otherwise, the value of C remains the zero. Once the value of C is set to zero, the signal analysis process discussed above is reset and repeated for coke cutting of next layer. The parameters $N_T$, and threshold values are selected off-line by acquiring and examining vibration signals during coke cutting and calibrated against the condition of coke cutting at different stages. Alternative methods may be used to determine the value of monitoring parameter C. For example, temporal change of vibration energy $z_m$ is also a good indicator of coke cutting condition. When the coke layer is completely removed, $z_m$ becomes steady and change with time is small. Therefore a data set of $\Delta z_m$ (i.e, $\Delta z_m(n)=z_m(n)-z_m(n-1)$, $\Delta z_m(n-1)=z_m(n-1)-z_m(n-2)$, . . . ) can be used in estimating $P(E/Z_m)$ in equation (3) instead of $z_m$, and a threshold $\Delta z_{threshold}$ instead of $z_{threshold}$.

The important parameters in the signal analysis includes the number of modes and modal frequencies, the coefficients of band filters, the window length of modal vibration energy computation, total number of data points in estimation of the conditional probability, the modal vibration energy threshold and probability threshold. The selection of those parameters may require calibration with vibration measurement and data analysis for a specific coker drum.

The invention monitors the vibrations in the coker drum wall and controls the rotary water jet drill accordingly based on the signal analysis as discussed above. The control of the water jet drill can be implemented with open or closed loop. With an open control loop, the computerized vibration data acquisition and analysis (4) is used to estimate the status of the coke cutting operation automatically, but adjustment of the jet drill can be made manually by an operator. For example, if the output of the system is a unit value of C, the operator will move the jet drill to next layer. Otherwise, he/she keeps the jet drill at the current layer for continuing cutting.

With a closed control loop, coke cutting operation can be made fully automated. The coke-cutting automation system may consist of one or more vibration transducers strategically located on the drum, a position sensor of measuring the position of the jet drill, an actuator that controls the movement of the jet drill, a computerized vibration data acquisition and signal analysis unit that continuously determines the vibration signature of the coke cutting and estimates the status of the cutting condition, and a controller and controlling algorithm that control the movement of the cutting jet (position and speed). The operation of the automation system can be described as follows:

(1) cut a pilot hole through the coke drum and lift the jet to the top of the drum
(2) lower the jet to the top coke layer and start the cutting while collecting the wall vibration data
(3) band-filter the vibration data with a pre-determined filter to extract modal vibration and calculate the modal vibration energy over a small moving time-window
(4) Computing the conditional probability of the event that coke layer is completely removed given the vibration measurements. If the estimate of the probability is below the pre-determined threshold, continue the cutting at the current position. If it is above the threshold, start lowering the cutting jet drill to the next coke layer
(5) continue step 3 and 4 until whole drum is cleaned.

Variation of the operation can be used to achieve the same goal. For example, instead of using time-domain band filter, short-time Fourier spectrum analysis can be used to extract the desirable signatures. There may be number of different ways to implement the automation process with the vibration signatures. For example, a fuzzy-logic controller may be considered for robustness.

Figure 7:
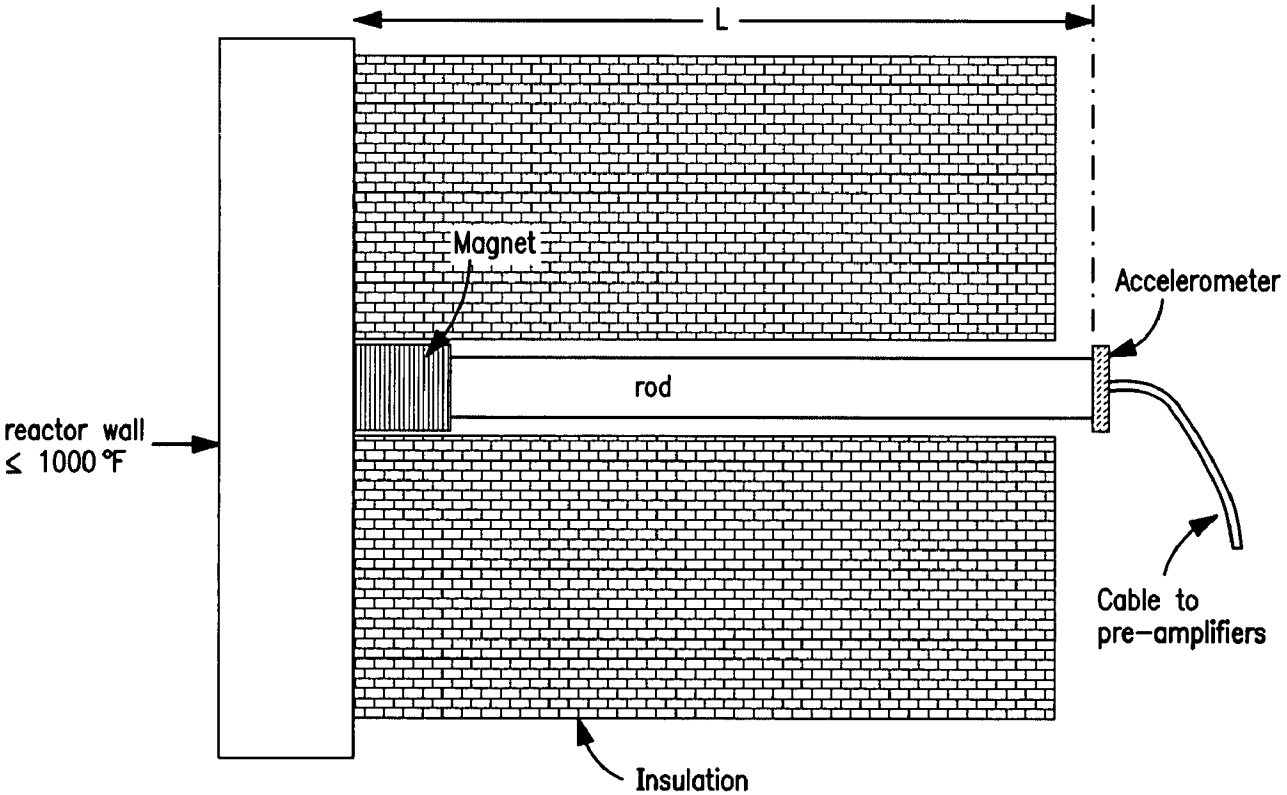
FIG. 7 shows a schematic for magnetically coupling accelerometer to delayed coking drum.

The present invention includes a means to utilize low cost, low temperature, commercially available accelerometers to measure the vibrations of high temperature surfaces of the coker drum, thereby eliminating the need for significantly higher cost, high temperature accelerometers. The low temperature accelerometer and cable is attached to a rod whose opposite end is attached to a permanent magnet (see FIG. 7). The magnet is used to affix the rod-accelerometer assembly to the ferromagnetic reactor wall. The permanent magnet material should have high Curie temperature, remanence, and coercivity, and a low value of thermal loss coefficient. Cast and sintered Alnico 5 are examples of suitable materials for use on reactor surfaces of 1000° F. or less. Sintered Alnico 5 is preferred but is more expensive. The magnet preferably has a geometry with multiple poles with ground faces which serve to provide multiple points of contact on reactor surfaces which may neither be flat nor smooth. The length of the rod separating the accelerometer and permanent magnet may contain cooling fins. The minimum length of the rod is determined by the greater of the reactor insulation thickness and the length required to reduce the temperature at the accelerometer to the maximum operating temperature of the low temperature accelerometer. The material of the rod may be thermally insulating or conducting or a combination of materials. The material is preferably of low density so as to minimize the torque on the magnet that would tend to reduce its holding power onto the reactor wall.

Figure 8:
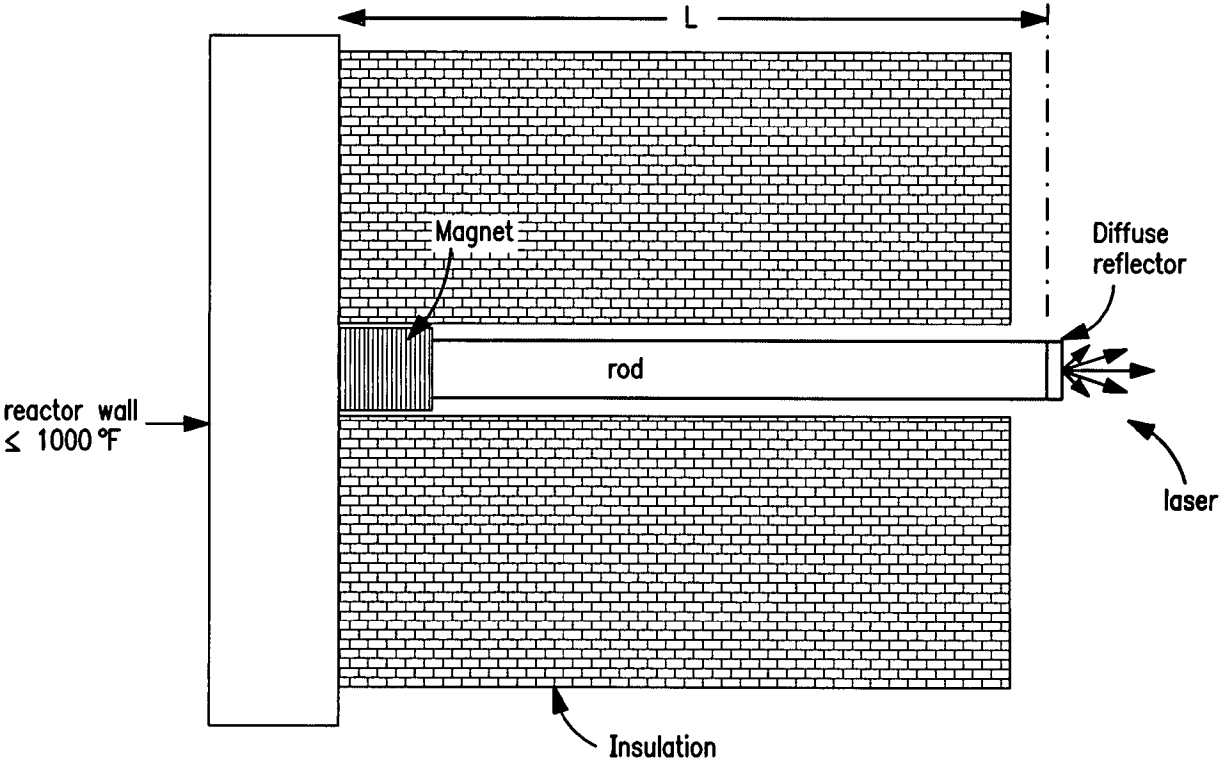
FIG. 8 shows a schematic wherein the accelerometer is replaced by a high reflectivity diffuse reflector.

The above method means may also be used, with little modification, to improve the optical method for remote, non-contact measurement of the vessel surface vibration. In this embodiment, the accelerometer is replaced by a high reflectivity diffuse reflector as shown in FIG. 8.

This embodiment has two advantages. Firstly, the measurement means permits the vibration spectra of the vessel surface to be measured by the laser in the case that the surface is covered by insulation. Secondly, it minimizes the amount of thermal insulation that must be removed in order for the incident laser radiation to impinge on the surface. This is particularly important if the remote laser and the point on the surface to be measured are at substantially different elevations resulting in a large angle of incidence required for the laser to reach the surface and for thick layers of insulation. Thirdly, the diffuse reflector increases the amount of reflected laser light that is dynamically Doppler shifted by the surface vibrations, thereby resulting in a more reliable measurement of the surface vibrations.

What is claimed is:

1. A method to remove coke from a coker drum comprising:

a) impinging a fluid from fluid jet on a layer of coke on the inside surface of a section of said coker drum, b) determining a vibration signal for a time period on a wall of the coke drum, c) determining amplitude versus frequency by a Fourier Transform of the vibration signal, d) repeating steps a) to c), until the vibration signal indicates that the layer of coke is removed from the section of the coker drum, e) impinging the fluid jet into a new layer of coke when the amplitude versus frequency of step d) indicates that a layer of coke has been removed and then repeating steps a) through d) until all of the coke has been removed from the coker drum.

2. The method of claim 1 wherein the vibration signal is determined on an exterior drum wall.

3. The method of claim 1 wherein step c) is carried out with a fast Fourier Transform.

4. The method of claim 1 wherein said vibration signal is limited to a frequency range centered about a resonance frequency of the coker wall.

5. The method of claim 4 wherein said resonance frequency is 1800 Hz.

6. The method of claim 4 wherein said resonance frequency is 3600 Hz.

7. The method of claim 4 wherein said frequency range is limited by a band filter.

8. The method of claim 1 further comprising the step of determining the vibration energy from said vibration signal.

9. The method of claim 8 wherein step e) is determined by a change in vibration energy.

10. The method of claim 9 wherein the change in vibration energy is used to determine if the coke has been removed from the coker wall.

11. The method of claim 1 wherein the vibration signal is determined by accelerometers in contact with the coker wall.

12. The method of claim 5 wherein said accelerometer is in contact with said coker wall by means of a rod.

13. The method of claim 6 wherein said rod is in contact with said coker wall by means of a magnet.

14. The method of claim 1 wherein said vibration signal is determined by a diffuse reflector.

15. The method of claim 1 wherein said vibration signal is determined by a diffuse reflector and a laser.

16. The method of claim 1 wherein said fluid is water.

* * * * *